US009946201B2

(12) United States Patent
Katada

(10) Patent No.: US 9,946,201 B2
(45) Date of Patent: Apr. 17, 2018

(54) IMAGE-FORMING APPARATUS AND IMAGE-FORMING SYSTEM

(71) Applicant: KONICA MINOLTA, INC., Chiyoda-ku, Tokyo (JP)

(72) Inventor: Kazunori Katada, Tokyo (JP)

(73) Assignee: KONICA MINOLTA, INC., Chiyoda-Ku (JP)

( * ) Notice: Subject to any disclaimer, the term of this patent is extended or adjusted under 35 U.S.C. 154(b) by 0 days.

(21) Appl. No.: 15/264,692

(22) Filed: Sep. 14, 2016

(65) Prior Publication Data

US 2017/0090362 A1 Mar. 30, 2017

(30) Foreign Application Priority Data

Sep. 25, 2015 (JP) ..... 2015-187866

(51) Int. Cl.
*G03G 15/00* (2006.01)
*G03G 15/20* (2006.01)

(52) U.S. Cl.
CPC ..... *G03G 15/2039* (2013.01); *G03G 15/2017* (2013.01); *G03G 15/6517* (2013.01)

(58) Field of Classification Search
CPC ..... G03G 15/2039; G03G 15/6573; G03G 15/2064; G03G 21/206
USPC ..... 399/375, 384
See application file for complete search history.

(56) References Cited

U.S. PATENT DOCUMENTS

2004/0131406 A1* 7/2004 Ohki ..... G03G 15/6576 399/384

FOREIGN PATENT DOCUMENTS

JP 2008-233770 A 10/2008

* cited by examiner

*Primary Examiner* — Walter L Lindsay, Jr.
*Assistant Examiner* — Jessica L Eley
(74) *Attorney, Agent, or Firm* — Buchanan Ingersoll & Rooney PC

(57) ABSTRACT

An image-forming apparatus contains a control portion that controls a cooling operation of the fixing portion. The control portion sets an image confirmable position in which an image formed on a long sheet is confirmable. When a print job on the long sheet finishes, the control portion starts the cooling operation of the fixing portion and controls the conveying portion to convey the long sheet until a rear end of a final image fixed by a fixing portion reaches the image confirmable position and finishes the cooling operation of the fixing portion until the rear end of the image fixed by the fixing portion reaches the image confirmable position. The control portion also sets the image confirmable position to be at an outermost circumference of rolled paper reeled by a reeling apparatus.

12 Claims, 5 Drawing Sheets

IMAGE-FORMING APPARATUS AND IMAGE-FORMING SYSTEM

CROSS REFERENCE TO RELATED APPLICATION

The present invention contains subject matter related to Japanese Patent Application JP 2015-187866 filed in the Japanese Patent Office on Sep. 25, 2015, the entire contents of which being incorporated herein by reference.

BACKGROUND OF THE INVENTION

Field of the Invention

The present invention relates to an image-forming apparatus that forms an image on a long sheet by transferring and fixing toner images on the long sheet, and an image-forming system using the image-forming apparatus.

Description of Related Art

An image-forming apparatus adopting an electrophotographic system such as a printer, a copier or the like has been known in the past. In such an image-forming apparatus, when forming the image(s) on a long sheet, the long sheet may remain on a paper-conveying route even after the image has been formed.

Such an image-forming apparatus has a fixing device for fixing the toner images transferred on the long sheet by heating under pressure. The fixing device includes a pair of rollers, a belt and rollers and the like. The fixing device nips the long sheet with any pressure being applied to it and heats the rollers and the like by a heater which generates heat by energization.

Since the long sheet is still present on the paper-conveying route in such an image-forming apparatus after the image has been formed, any marks may be leaved on the long sheet by heat or the long sheet may be deformed by heat when the rollers and the like of the fixing device contacts the long sheet after the image has been formed while the rollers and the like have been not sufficiently cooled.

Accordingly, Japanese Patent Application Publication No. 2008-233770 has proposed a technology such that the rollers and the like of the fixing device are released from the long sheet after the image has been formed and the rollers and the like of the fixing device and the long sheet are prevented from contacting to each other by inhibiting the long sheet from being bent.

SUMMARY OF THE INVENTION

However, even when the rollers and the like of the fixing device are released from the long sheet after the image has been formed while the rollers and the like have been not sufficiently cooled, it may be difficult to prevent the rollers and the like of the fixing device and the long sheet from contacting to each other. As a result, there is such a possibility that any marks may be leaved on the long sheet by heat or the long sheet may be deformed by heat.

On the other hand, a technology for cooling the fixing device after the image has been formed with the long sheet being conveyed has also been proposed. In such a technology, however, the image formed long sheet has reeled as rolled paper on a reeling apparatus. When cooling the fixing device after the image has been formed with the long sheet being conveyed, a part of the long sheet on which the image has been formed also rolls as the rolled paper, so that it may be difficult to find out the image(s) formed on the long sheet.

The present invention addresses the above-described issue. The present invention has objects to provide an image-forming apparatus that suppresses any influence by heat on the long sheet after the image has been formed and easily searches the image(s) formed on the long sheet and to provide the image-forming system using the image-forming apparatus.

To achieve at least one of the above-described objects, an image-forming apparatus that is connected to a supplying apparatus for supplying a long sheet and a reeling apparatus for reeling the long sheet, contains a conveying portion that conveys the long sheet which is supplied from the supplying apparatus and reeled by the reeling apparatus, an image-forming portion that forms an image on the long sheet conveyed by the conveying portion, a fixing portion that fixes the image on the long sheet on which the image-forming portion has formed the image, and a control portion that is configured to control a cooling operation of the fixing portion wherein an image confirmable position in which the image formed on the long sheet is confirmable is set to be within a range from a start position in an image confirmable range, the start position being set at a downstream side of the fixing portion along a conveying direction of the long sheet, to a finishing position in the image confirmable range, the finishing position being set at an outermost circumference of rolled paper reeled by the reeling apparatus, and when an image-forming operation on the long sheet finishes, the control portion is configured to start the cooling operation of the fixing portion, to control the conveying portion to convey the long sheet until a rear end of the image fixed by the fixing portion reaches the image confirmable position and to finish the cooling operation of the fixing portion until the rear end of the image fixed by the fixing portion reaches the image confirmable position.

According to embodiments of the present invention, it is desired to provide the image-forming apparatus wherein the control portion is configured to set the image confirmable position to be within a range from the start position in the image confirmable range, the start position being set at an introducing port of the reeling apparatus from which the long sheet is introduced to the reeling apparatus, to a finishing position in the image confirmable range, the finishing position being set at the outermost circumference of rolled paper reeled by the reeling apparatus.

It is also desired to provide the image-forming apparatus wherein the control portion is configured to set the image confirmable position to be at the outermost circumference of the rolled paper reeled by the reeling apparatus.

It is further desired to provide the image-forming apparatus further containing a temperature detection portion that detects temperature of the fixing portion wherein the control portion is configured to perform the cooling operation on the fixing portion until the temperature of the fixing portion detected by the temperature detection portion becomes cooling temperature or less.

It is additionally desired to provide the image-forming apparatus wherein the control portion is configured to change a conveying speed of the long sheet from the conveying speed thereof at the image-forming time, when the image-forming portion has formed the image on the long sheet.

It is still also desired to provide the image-forming apparatus wherein the control portion is configured to change a conveying speed of the long sheet from the conveying speed thereof at the image-forming time based on the temperature of the fixing portion detected by the temperature detection portion, when the image-forming portion has formed the image on the long sheet.

It is still further desired to provide the image-forming apparatus wherein the control portion is configured to change a conveying speed of the long sheet from the conveying speed thereof at the image-forming time based on the temperature of the fixing portion detected by the temperature detection portion and a distance up to the image confirmable position, when the image-forming portion has formed the image on the long sheet.

It is still additionally desired to provide the image-forming apparatus further containing a cooling portion that blows air to the fixing portion wherein the control portion is configured to control the cooling portion to perform a cooling operation on the fixing portion by any of stopping energization to the fixing portion, reducing a value of voltage across the fixing portion or a value of current flowing through the fixing portion, and blowing the air by the cooling portion or a combination thereof.

It is still further desired to provide the image-forming apparatus wherein the fixing portion is provided with a driving mechanism to drive a pair of a fixing roller and a pressure roller so as to contact to each other with the fixing roller and the pressure roller being pressured or to be released from each other, and the control portion is configured to control the driving mechanism to contact the long sheet to the fixing roller by the pressure roller under pressure and to perform the cooling operation on the fixing portion with the long sheet being conveyed, and is configured to control the driving mechanism to release the pressure roller from the fixing roller to release the long sheet from the fixing roller.

Other objects and attainments of the present invention will be become apparent to those skilled in the art upon a reading of the following detailed description when taken in conjunction with the drawing.

DESCRIPTION OF THE PREFERRED EMBODIMENTS

Figure 1:
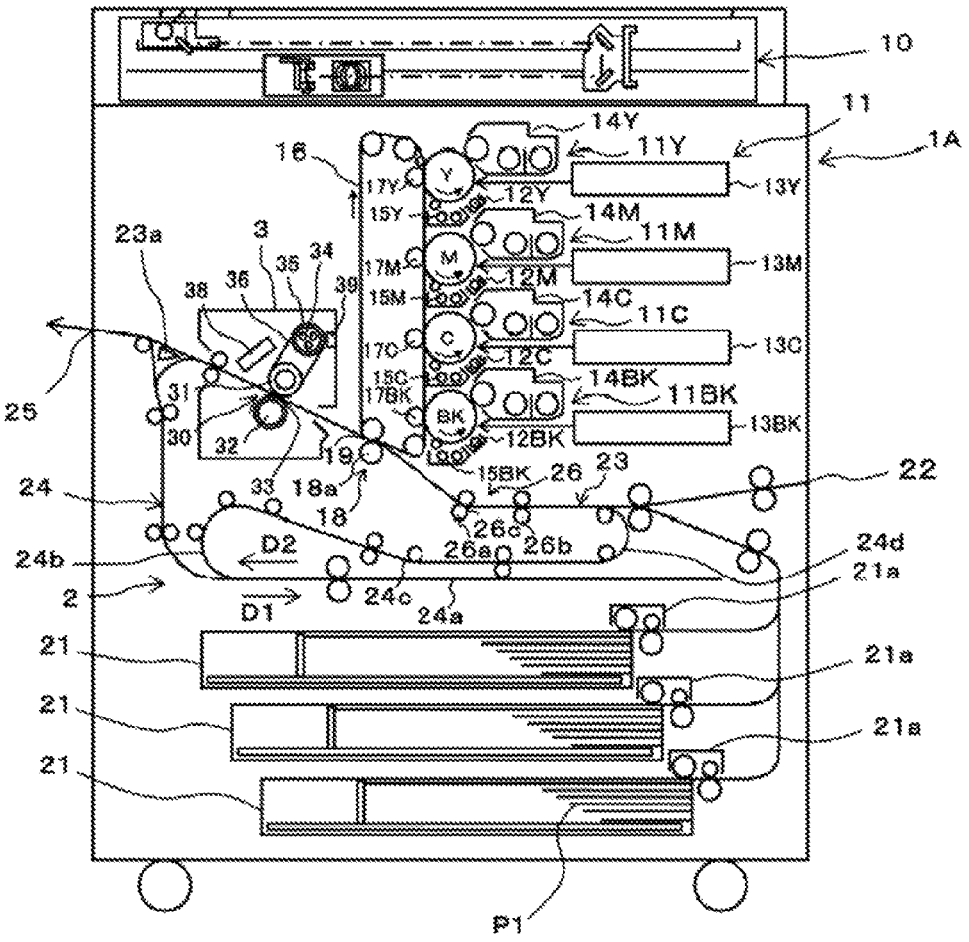
FIG. 1 is a diagram showing a configuration example of an image-forming apparatus according to an embodiment of the invention.

The following will describe preferred embodiments of an image-forming apparatus and an image-forming system according to the present invention with reference to the attached drawings. Such description does not limit the technical scope, meaning of terms and the like in Claims. Size and/or ratio in the drawings are exaggerated for convenience of explanation and they may be different from real ones.

<Configuration Examples of Image-Forming Apparatus and Image-Forming System according to Embodiment of the Invention>

Figure 2:
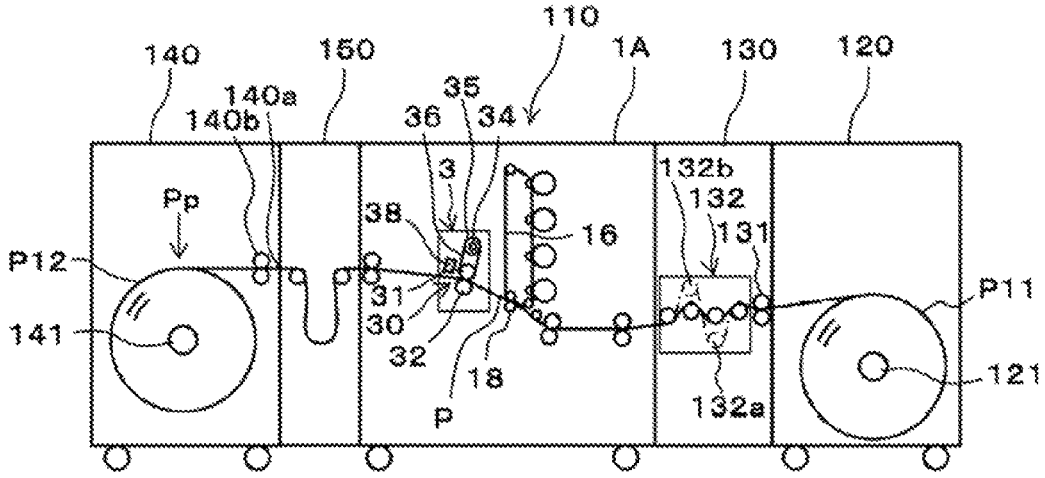
FIG. 2 is a diagram showing a configuration example of an image-forming system according to an embodiment of the invention.

FIG. 1 shows a configuration example of an image-forming apparatus 1A according to an embodiment of the invention. FIG. 2 shows a configuration example of an image-forming system 110 according to an embodiment of the invention.

As shown in FIG. 1, the image-forming apparatus 1A is an image-forming apparatus of an electrophotographic system such as a copier. In this embodiment, the image-forming apparatus 1A is a color image-forming apparatus of a so-called tandem type in which plural photoreceptors are vertically arranged to face one intermediate transfer belt, thereby forming a full color image.

The image-forming system 110 according to the embodiment of the invention is configured to form image(s) on a long sheet P by the image-forming apparatus 1A. As shown in FIG. 2, the image-forming system 110 includes the image-forming apparatus 1A, a sheet-supplying apparatus 120 that stores the long sheet P to be fed to the image-forming apparatus 1A and a sheet feeder 130 that receives the long sheet P from the sheet-supplying apparatus 120 and feeds it to the image-forming apparatus 1A. The image-forming system 110 also includes a reeling apparatus 140 that reels the long sheet P on which the image-forming apparatus 1A has formed the image.

Here, the long sheet P in this embodiment is referred to as "a sheet, a film, label paper in which a label adheres on release paper or the like, which has a length longer than that of a conveying path from a feeding port to an ejecting port in the image-forming apparatus 1A".

The sheet-supplying apparatus 120 stores rolled paper P11 in which the long sheet P on which any image is not yet formed rolls while an axis 121 supporting the rolled paper P11. The long sheet P is sent out of the sheet-supplying apparatus 120 together with rotation of the rolled paper P11.

The sheet feeder 130 includes sheet-feeding rollers 131 that send the long sheet P out of the sheet-supplying apparatus 120 to convey the long sheet P and a tension-applying device 132 that applies any tension onto the long sheet P cooperating with the image-forming apparatus 1A.

The tension-applying device 132 includes a first tension-applying roller 132*a* that contacts one surface, i.e., a surface of the long sheet P and a second tension-applying roller 132*b* that contacts the other surface, i.e., a back surface of the long sheet P.

The tension-applying device 132 is configured to move any one of, or both of the first tension-applying roller 132*a* and the second tension-applying roller 132*b* on a direction that is almost perpendicular to a conveying direction of the long sheet P by hand or according to a control value based on a conveying condition of the long sheet P, thereby allowing strength of any tension applied to the long sheet P to be adjusted.

The reeling apparatus 140 includes an introducing port 140*a* from which the long sheet P ejected from the image-forming apparatus 1A is introduced and conveying guide rollers 140*b* that are a pair of rollers for conveying the long sheet P. The conveying guide rollers 140*b* are arranged in the paper-conveying route of the long sheet P on at least one position along the conveying direction. The reeling apparatus 140 includes an axis 141 that is driven to rotate and reels the long sheet P ejected from the image-forming apparatus 1A on the axis 141 to produce rolled paper P12 in which the long sheet P on which the image has been formed rolls.

Additionally, a buffer device 150 may be set between the image-forming apparatus 1A and the reeling apparatus 140 for reducing a difference in set positions between the image-forming apparatus 1A and the reeling apparatus 140 and/or a difference in the tension of the long sheet P between the image-forming apparatus 1A and the reeling apparatus 140 by configuring the paper-conveying route in which the long sheet P is flexibly conveyed.

The following will describe a configuration of the image-forming apparatus 1A with reference to FIG. 1. The image-forming apparatus 1A contains a document-reading portion 10, an image-forming portion 11, a sheet-conveying portion 2 and a fixing portion 3.

The document-reading portion 10 scans and exposes an image on the document by optics of a scanning and exposing device and reads reflected light by a line image sensor to obtain an image signal. It is to be noted that the image-forming apparatus 1A may be configured so that an automatic document feeder, not shown, that feeds the document is mounted thereon.

The image-forming portion 11 includes an image-forming unit 11Y which forms a yellow (Y) image, an image-forming unit 11M which forms a magenta (M) image, an image-forming unit 11C which forms a cyan (C) image and an image-forming unit 11BK which forms a black (BK) image. In this embodiment, respective common function names are represented by Y, M, C and BK indicating respective colors to be formed following, for example, the numeral 11.

The image-forming unit 11Y contains a photosensitive drum Y, a charging portion 12Y positioned around the photosensitive drum Y, an optical writing portion 13Y, a developing portion 14Y and a drum cleaner 15Y. Similarly, the image-forming unit 11M contains a photosensitive drum M, a charging portion 12M positioned around the photosensitive drum M, an optical writing portion 13M, a developing portion 14M and a drum cleaner 15M. The image-forming unit 11C contains a photosensitive drum C, a charging portion 12C positioned around the photosensitive drum C, an optical writing portion 13C, a developing portion 14C and a drum cleaner 15C. The image-forming unit 11BK contains a photosensitive drum BK, a charging portion 12BK positioned around the photosensitive drum BK, an optical writing portion 13BK, a developing portion 14BK and a drum cleaner 15BK.

The charging portion 12Y charges a static charge uniformly around a surface of the photosensitive drum Y. The optical writing portion 13Y scans and exposes the surface of the photosensitive drum Y to form an electrostatic latent image on the photosensitive drum Y. The developing portion 14Y then develops the electrostatic latent image formed on the photosensitive drum Y by using toner. Accordingly, a yellowish visible toner image is formed on the photosensitive drum Y.

The charging portion 12M charges a static charge uniformly around a surface of the photosensitive drum M. The optical writing portion 13M scans and exposes the surface of the photosensitive drum M to form an electrostatic latent image on the photosensitive drum M. The developing portion 14M then develops the electrostatic latent image formed on the photosensitive drum M by using toner. Accordingly, a magenta visible toner image is formed on the photosensitive drum M.

The charging portion 12C charges a static charge uniformly around a surface of the photosensitive drum C. The optical writing portion 13C scans and exposes the surface of the photosensitive drum C to form an electrostatic latent image on the photosensitive drum C. The developing portion 14C then develops the electrostatic latent image formed on the photosensitive drum C by using toner. Accordingly, a cyanic visible toner image is formed on the photosensitive drum C.

The charging portion 12BK charges a static charge uniformly around a surface of the photosensitive drum BK. The optical writing portion 13BK scans and exposes the surface of the photosensitive drum BK to form an electrostatic latent image on the photosensitive drum BK. The developing portion 14BK then develops the electrostatic latent image formed on the photosensitive drum BK by using toner. Accordingly, a black visible toner image is formed on the photosensitive drum BK.

When a driving roller stretched the intermediate transfer belt 16, which is an example of a transfer belt as a belt-like intermediate transfer member, is driven to rotate, the intermediate transfer belt 16 is driven to rotate to an arrow direction. This enables the images formed on the photosensitive drums Y, M, C and BK to be transferred one by one to predetermined positions on the intermediate transfer belt 16 by primary transfer rollers 17Y, 17M, 17C and 17BK.

A secondary transfer portion 18 transfers each image composed of each color and transferred onto the intermediate transfer belt 16 on the long sheet P conveyed at predetermined timing by the sheet-conveying portion 2. The secondary transfer portion 18 is configured to arrange a secondary transfer roller 18*a* so as to contact the intermediate transfer belt 16 under pressure to form a transfer nip portion 19. By driving the secondary transfer roller 18*a* to rotate at the same speed as that of the intermediate transfer belt 16, the secondary transfer portion 18 transfers the images on the long sheet P with the long sheet being conveyed.

In the secondary transfer portion 18, in order to transfer the toner images on the long sheet P, the secondary transfer roller 18*a* applies positive voltage to the long sheet P from a side of back surface thereof. This enables the long sheet P passed through the secondary transfer portion 18 to be charged so that an image-forming surface of the long sheet P on which the toner images are transferred is negatively charged and the back surface thereof is positively charged.

The image-forming apparatus 1A may be also configured to perform an image-forming process on single sheet P1. The sheet-conveying portion 2 includes plural feeding trays 21 each storing the sheets P1 in this embodiment, and feeding portions 21*a* each sending the sheet P1 out of any of the feeding trays 21. The sheet-conveying portion 2 contains a main conveying route 23 and a reverse conveying route 24. On the main conveying route 23, the long sheet P sent out of the sheet feeder 130 or the sheet P1 sent out of any of the feeding trays 21 is conveyed. On the reverse conveying route 24, the sheet P1 is reversed.

The main conveying route 23 is configured to be a conveying path from the feeding trays 21 and the feeding port 22 to the ejection port 25. The conveying path from the feeding port 22 joins the main conveying route 23 at an upstream side of a joined position of the main conveying route 23 and the reverse conveying route 24. In the image-forming system 110 shown in FIG. 2, the sheet-supplying apparatus 120 and the sheet feeder 130 are connected to the feeding port 22 and the reeling apparatus 140 is connected to the ejection port 25.

The sheet-conveying portion 2 includes a position correcting mechanism 26 which corrects any skew of the long sheet P and the sheet P1 conveyed on the main conveying route 23 and corrects a deviation of position along a sheet width direction that is orthogonal to the sheet conveying direction. The position correcting mechanism 26 includes register rollers 26*a* which conveys the sheet P1 or the like with them nipping the sheet P1 or the like and moves the sheet P1 or the like to the sheet width direction with them nipping the sheet P1 or the like and loop rollers 26*b* which strike a forward end of the sheet P1 or the like against the register rollers 26*a*.

The loop rollers 26*b* convey the sheet P1 or the like while the register rollers 26*a* stop and strike the forward end of the sheet P1 against a nip portion 26*c* that is configured by a contacted portion of a pair of the register rollers 26*a* and then convey the sheet P1 so that it flexes and forms a loop, thereby correcting skew along a surface of the sheet P1.

After the skew of the sheet P1 or the like is corrected, the register rollers 26*b* are driven to rotate so that the sheet P1 is nipped and conveyed to the conveying direction thereof. Further, by moving the register rollers 26*a* to the sheet width direction of the sheet P1, which is orthogonal to the conveying direction of the sheet P1, the position of the sheet P1 along the sheet width direction thereof is corrected. As described above, a series of positional correction operation such that deviation in the position of the sheet P1 along the sheet width direction thereof is corrected while the sheet P1 is conveyed is referred to as "registration fluctuation". Further, in the long sheet P, any positional correction operation such that deviation in the position of the long sheet P along the sheet width direction thereof is corrected may be performed.

The reverse conveying route 24 constitutes a paper-conveying route in a duplex printing mode in which the images are formed on both of a surface and a back surface of the sheet P1. The reverse conveying route 24 branches off the main conveying route 23 at a downstream side of the fixing portion 3 and includes a change-over gate 23*a* around a branched position of the main conveying route 23 and the reverse conveying route 24. The reverse conveying route 24 also includes a first reverse conveying path 24*a* which branches off the main conveying route 23 and extends to almost a horizontal direction under the main conveying route 23. On the first reverse conveying path 24*a*, the conveying direction of the sheet P1 is reversed from an arrow direction D1 to an arrow direction D2.

The reverse conveying route 24 further includes a second reverse conveying path 24*b* which branches off the first reverse conveying path 24*a* upward in relation to the conveying direction shown by the arrow D2 and bends like about U-shape, and a third reverse conveying path 24*c* which extends from the second reverse conveying path 24*b* along the first reverse conveying path 24*a*. Additionally, the reverse conveying route 24 includes a fourth reverse conveying path 24*d* which bends like about U-shape from the third reverse conveying path 24*c* and joins the main conveying route 23.

In the image-forming apparatus 1A, the image(s) is (are) formed on the upward faced surface of the sheet P1 which has been conveyed on the main conveying route 23 and has passed through the transfer nip portion 19 and the fixing portion 3. When the images are formed on both surfaces of the sheet P1, the sheet P1, on the upward faced surface of which the image has been formed, is conveyed from the main conveying route 23 to the first reverse conveying path 24*a* of the reverse conveying route 24, so that the image-formed surface thereof faces downward.

When the sheet P1 conveyed to the first reverse conveying path 24*a* is conveyed from the second reverse conveying path 24*b* to the third reverse conveying path 24*c*, the image-formed surface of the sheet P1 faces upward. When the sheet P1 conveyed to the third reverse conveying path 24*c* is conveyed from the fourth reverse conveying path 24*d* to the main conveying route 23, the image-formed surface thereof faces downward. Thus, the sheet P1 is reversed so that the image can be formed on the other surface faced upward.

Figure 3:
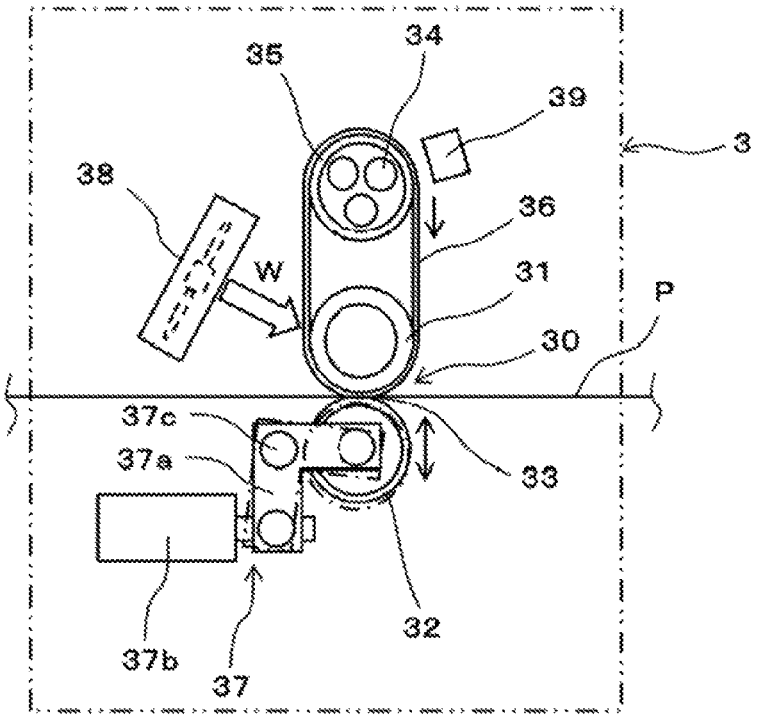
FIG. 3 is a diagram showing a configuration example of a fixing portion according to an embodiment of the invention.

FIG. 3 shows an example of the fixing portion 3 according to this embodiment. The fixing portion 3 performs a fixing process for fixing the toner images on the long sheet P to which the toner images has been transferred. The fixing portion 3 includes a fixing roller 31 and a pressure roller 32 as a pair of pressure rotation members 30 that are arranged so that they can contact to each other under pressure and can be released from each other. In the fixing portion 3, the fixing roller 31 and the pressure roller 32 contact to each other under pressure to form a fixing nip portion 33.

The fixing portion 3 includes a fixing heater 34 for heating the pressure rotation members 30. For the fixing heater 34, for example, a halogen lamp is used which is switched on by energization to generate heat.

The fixing portion 3 adopts a system using an endless belt in this embodiment and includes a heating roller 35 that is heated by the fixing heater 34 and a fixing belt 36 that transmits heat from the heating roller 35 to the fixing roller 31.

The heating roller 35 includes the fixing heater 34 at an interior thereof. By energizing the fixing heater 34, the heating roller 35 is heated. The fixing belt 36 is stretched between the fixing roller 31 and the heating roller 35.

Thus, in the fixing portion 3, by heating the heating roller 35 with the fixing heater 34, the fixing belt 36 stretching the heating roller 35 is heated so that the fixing roller 31 stretching the fixing belt 36 is also heated.

In the fixing portion 3, by controlling a value of voltage across the fixing heater 34 or a value of current flows through the fixing heater 34, temperature of the fixing roller 31 and the fixing belt 36 is controlled.

The fixing portion 3 includes a driving mechanism 37 that is driven to contact the fixing roller 31 and the pressure roller 32 to each other under pressure or to be released from each other. The driving mechanism 37 includes, in this embodiment, a supporting member 37*a* and an actuator 37*b*, which contact the pressure roller 32 to the fixing roller 31 under pressure or release them from each other. In this embodiment, the driving mechanism 37 contacts the pressure roller 32 to the fixing roller 31 under pressure or releases them from each other by rotation of the supporting member 37*a* as a fulcrum of an axis 37*c* by an operation of the actuator 37*b*.

In the fixing portion 3, the fixing roller 31 rotates with the pressure roller 32 contacting the fixing roller 31 under pressure and the fixing heater 34 is energized. Thereby, the long sheet P nipped by the fixing nip portion 33 is conveyed and the fixing roller 31 and the pressure roller 32 performs fixing process with pressure and the fixing heater 34 performs fixing process with heating, so that the image(s) is (are) fixed on the long sheet P.

The fixing portion 3 also includes a cooling fan 38 for cooling the pressure rotation members 30. The cooling fan 38 cools the fixing roller 31 and the fixing belt 36 stretching the fixing roller 31 by blowing a wind W toward the fixing roller 31.

The fixing portion 3 further includes a temperature sensor 39 that detects temperature of the pressure rotation members 30. The temperature sensor 39 is arranged at a position in which the temperature near the heating roller 35 and the fixing belt 36 stretching the heating roller 35 can be detected.

In the fixing portion 3, by stopping the energization of the fixing heater 34, or reducing the value of voltage across the fixing heater 34 or the value of current flowing through the fixing heater 34, the temperature of the fixing roller 31 and the pressure roller 32 constituting the pressure rotation members 30, the fixing heater 34 for heating the pressure rotation members 30, the heating roller 35 and the fixing belt 36 is dropped. Further, by stopping the energization of the fixing heater 34 or reducing the value of voltage across the fixing heater 34 or the value of current flowing through the fixing heater 34, and driving the cooling fan 38, cooling of the pressure rotation members 30 is improved.

In the fixing portion 3, by detecting the temperature of the position near the heating roller 35, to which the wind W blowing out of the cooling fan 38 is not directly blown, by means of the temperature sensor 39, it is possible to detect the temperature of the fixing roller 31 and the like constituting the pressure rotation members 30, excluding any influence of the wind W by the cooling fan 38. The temperature of the fixing roller 31 and the like detected by the temperature sensor 39 is also referred to as "fixing portion temperature t".

<Example of Control Function of Image-Forming Apparatus and Image-Forming System according to Embodiment of the Invention>

Figure 4:
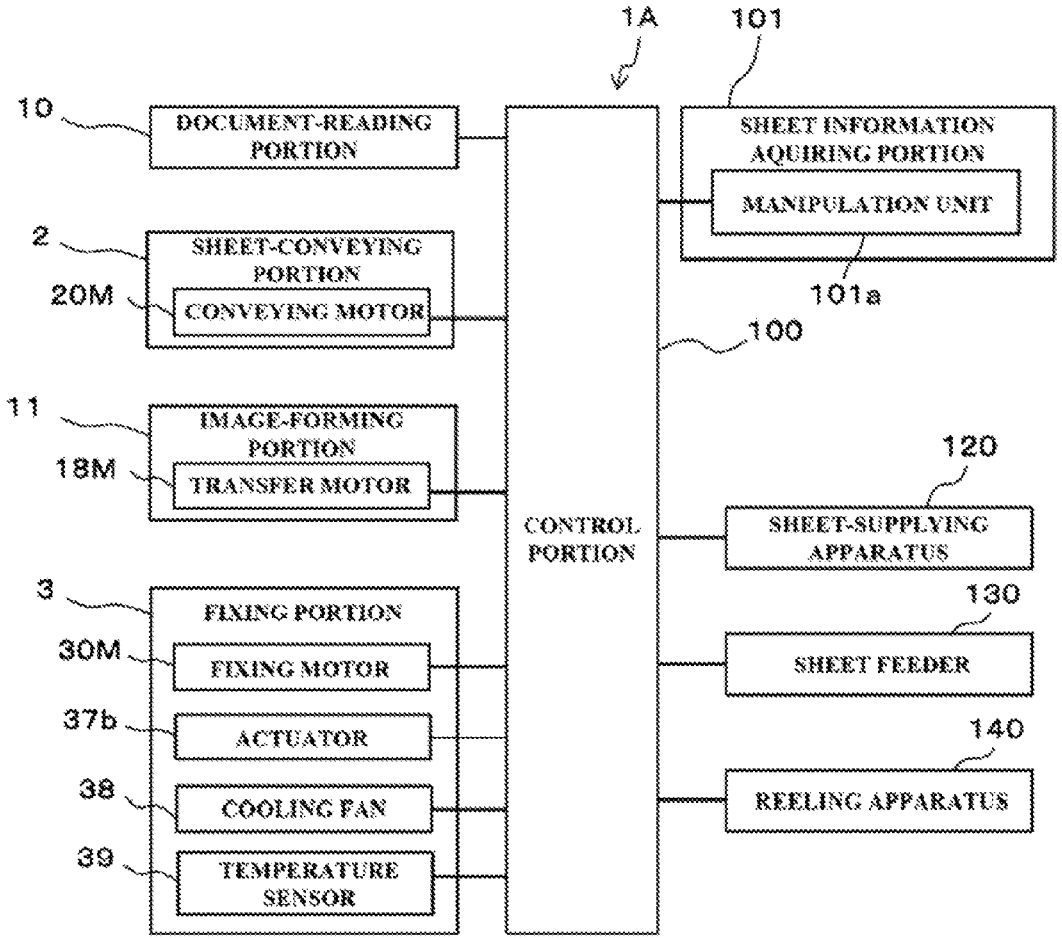
FIG. 4 is a block diagram showing an example of control function of the image-forming apparatus and the image-forming system according to an embodiment of the invention.

FIG. 4 shows an example of control function of the image-forming apparatus and the image-forming system according town embodiment of the invention. The following will describe a control function in which the conveying operation of the long sheet P and the cooling operation of cooling the pressure rotation members 30 are worked together after the image(s) is (are) formed on the long sheet P.

The image-forming apparatus 1A contains a control portion 100 for performing a series of controls, in this embodiment, of feeding the long sheet P, forming the image(s) on the long sheet P or the like and ejecting the sheet. The control portion 100 includes a microprocessor such as a central processing unit (CPU) or micro processing unit (MPU), and a memory such as a read only memory (ROM) or a random access memory (RAM).

The image-forming apparatus 1A also contains a sheet information acquiring portion 101 that acquires any sheet information such as species of the long sheet P. The sheet information acquiring portion 101 is composed of a manipulation unit 101*a* and the like. The manipulation unit 101*a* allows a user to select paper weight of the sheet, species of the sheet, a size of the sheet and the like.

The following will describe an outline of the operation for forming the image(s) on the long sheet P using the image-forming apparatus 1A. The control portion 100 controls the image-forming portion 11 based on image data acquired from the document by the document-reading portion 10 or image data acquired from outside. The control portion 100 also controls a conveying motor 20M for conveying the long sheet P in the sheet-conveying portion 2 and a fixing motor 18M for conveying the long sheet P in the secondary transfer portion 18 to transfer the toner images on the long sheet P. The control portion 100 further controls the fixing heater 34 and a fixing motor 30M for conveying the long sheet P in the fixing portion 3 to fix the toner images on the long sheet P.

The control portion 100, when determining that a forming operation of the image(s) on the long sheet P finishes, starts the cooling operation of the pressure rotation members 30. For example, the control portion 100 stops the energization to the fixing heater 34 as the cooling operation of the pressure rotation members 30. Alternatively, the control portion 100 reduces the value of voltage across the fixing heater 34 or the value of current flowing through the fixing heater 34 down to a predetermined waiting voltage value or a predetermined waiting current value. The control portion 100 further drives the cooling fan 38.

The control portion 100, when determining that a forming operation of the image(s) on the long sheet P finishes, controls the sheet-conveying portion 2 to convey the long sheet P up to an image confirmable position Pp at which the image(s) formed on the long sheet P can be confirmed by sight in the paper-conveying route of the long sheet P between the fixing portion 3 and the reeling apparatus 140.

The image confirmable position Pp may be set to be within a range from the introducing port 140*a* of the reeling apparatus 140 or the conveying guide rollers 140*b* provided at an uppermost stream side in the reeling apparatus 140 to a position in which the image(s) is (are) exposed at an outermost circumference of rolled paper P12 that is formed by reeling the long sheet P with the reeling apparatus 140. In this embodiment, when estimating that the rolled paper P12 is a circle and the long sheet P to be reeled as the rolled paper P12 is a tangent line, a position corresponding to a point of contact is set to be the image confirmable position Pp.

The control portion 100 controls the sheet-conveying portion 2 to convey the long sheet P until a rear end of the final image fixed by the fixing portion 3 reaches the image confirmable position Pp.

The control portion 100 controls a conveying speed of the long sheet P based on the fixing portion temperature t detected by the temperature sensor 39 so that the cooling operation of the pressure rotation members 30 finishes until the rear end of the final image fixed by the fixing portion 3 reaches the image confirmable position Pp. Alternatively, the control portion 100 controls numbers of revolution in the cooling fan 38. The control portion 100 also control contact and release operation in the fixing roller 31 and the pressure roller 32.

<Operation Example of Image-Forming Apparatus and Image-Forming System according to Embodiment of the Invention>

Figure 5:
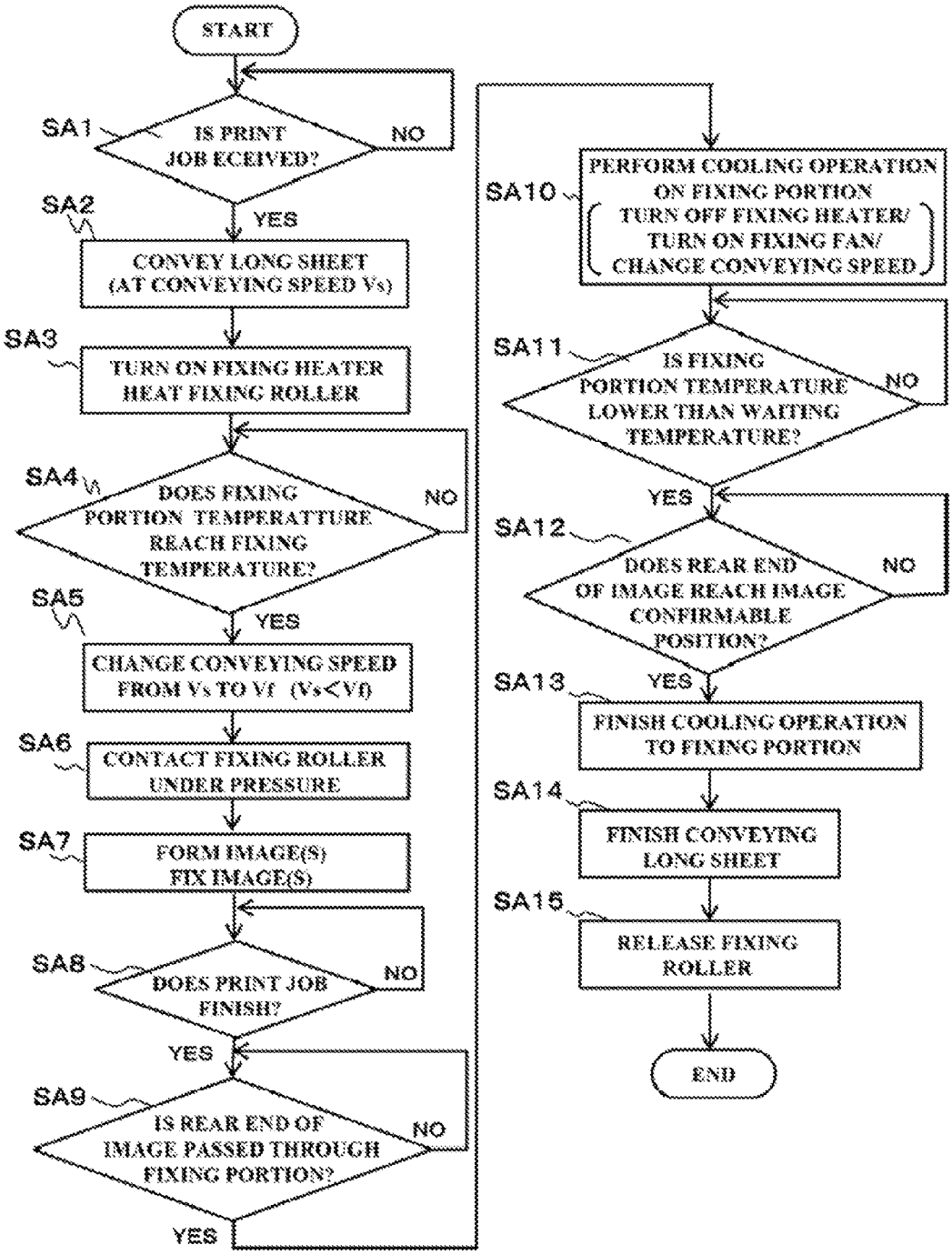
FIG. 5 is a flowchart showing an operation example of the image-forming apparatus and the image-forming system according to an embodiment of the invention.
Figure 6:
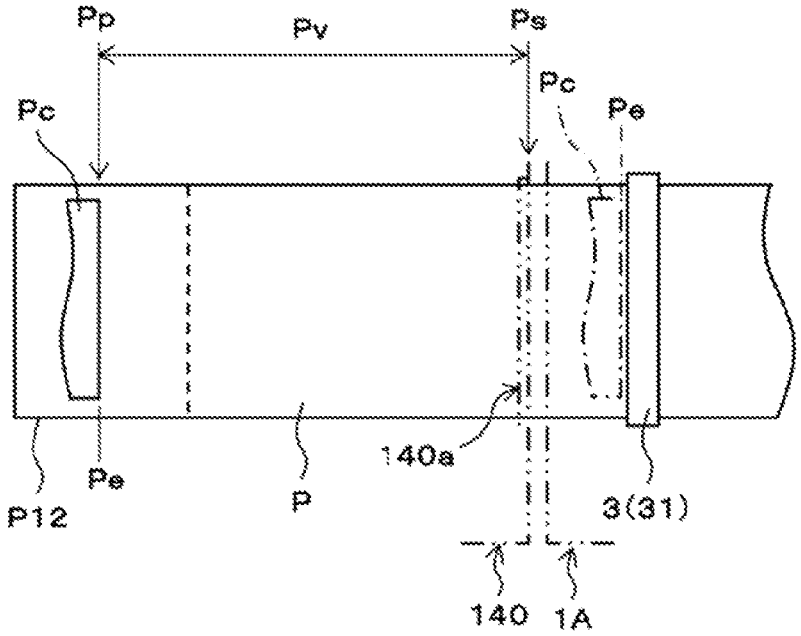
FIG. 6 is a diagram showing a conveying example of the long sheet in the image-forming apparatus and the image-forming system according to an embodiment of the invention.

FIG. 5 shows an operation example of the image-forming apparatus and the image-forming system according to an embodiment of the invention. FIG. 6 shows a conveying example of the long sheet in the image-forming apparatus and the image-forming system according to the embodiment of the invention. The following will describe the operation example of the image-forming apparatus and the image-forming system according to this embodiment of the invention with reference to drawings.

The control portion 100 determines whether or not a print job for forming the image(s) is received at a step SA1 shown in FIG. 5. If received, the control portion 100 is configured to drive the conveying motor 20M, the transfer motor 18M and the fixing motor 30M at a step SA2 shown in FIG. 5 and drives the sheet feeder 130 and the reeling apparatus 140 to start the conveyance of the long sheet P at a predetermined conveying speed Vs. The conveying speed Vs is set to be slower than the conveying speed Vf of the long sheet P in transferring toner images onto the long sheet P in the image-forming portion 11 and in forming the image(s) by fixing the toner images onto the long sheet P in the fixing portion 3.

The control portion 100 is configured to energize the fixing heater 34 to start heating the fixing rollers 31 and the like constituting the pressure rotation members 30 at a step SA3 shown in FIG. 5. When energizing the fixing heater 34, the fixing heater 34 heats the heating roller 35, so that the heating belt 36 stretching the heating roller 35 is heated and the fixing roller 31 to which the heating belt 36 is stretched is heated. The control portion 100 is configured to increase the fixing portion temperature t from waiting temperature Tw to the fixing temperature Th by controlling the value of voltage across the fixing heater 34 or the value of current flowing through the fixing heater 34.

When the fixing heater 34 is driven at a predetermined waiting voltage value or a predetermined waiting current value in order to maintain the fixing portion temperature t to be the waiting temperature Tw while there is no print job and no image is formed, after the print job starts, an operation may be performed in which the value of voltage across the fixing heater 34 or the value of current flowing through the fixing heater 34 is increased from the waiting voltage value or the waiting current value.

By reducing the conveying speed of the long sheet P to be slower than that at the image-forming time during a warmup operation in which the fixing portion temperature t is increased to the fixing temperature Th, it is possible to reduce an amount of conveyance of the long sheet P until the fixing portion temperature t becomes a temperature at which the image(s) can be fixed in the fixing portion 3. On the other hand, the conveyance of the long sheet P enables any heat to be applied to the same portion of the long sheet P to be prevented during a step in which the fixing portion temperature t is increased. This can suppress any influence of heat applied to the long sheet P by the fixing roller 31.

If the control portion 100 determines that the fixing portion temperature t detected by the temperature sensor 39 reaches the predetermined fixing temperature Th at a step SA4 shown in FIG. 5, the control portion 100 changes the conveying speed Vs of the long sheet P at the warmup time to the conveying speed Vf of the long sheet P at the image-forming time (Vf>Vs) at a step SA5 shown in FIG. 5. The control portion 100 then controls the actuator 37*b* to contact the pressure roller 32 to the fixing roller 31, at a step SA6 shown in FIG. 5, so that the long sheet P can contact the fixing roller 31 under pressure.

The control portion 100 then controls the image-forming portion 11 to transfer the toner images on the long sheet P and form the image(s) thereon and controls the fixing portion 3 to fix the images on the long sheet P by heating under pressure at a step SA7 shown in FIG. 5.

If the control portion 100 determines that the print job finishes at a step SA8 shown in FIG. 5, the control portion 100 determines, at a step SA9 shown in FIG. 5, whether or not a rear end Pe of the final image Pc that is formed before the print job has finished passes through the fixing portion 3 as shown by one dot chain line in FIG. 6 to finish the fixing operation.

When the control portion 100 determines that the rear end Pe of the final image Pc passes through the fixing portion 3, the control portion 100 is configured to start the cooling operation on the fixing roller 31 and the like at a step SA10 shown in FIG. 5. The control portion 100 stops the energization to the fixing roller 34 as the cooling operation of the fixing roller 31 and the like. Alternatively, the control portion 100 reduces the value of voltage across the fixing heater 34 or the value of current flowing through the fixing heater 34 to a predetermined waiting voltage value or a predetermined waiting current value. The control portion 100 is configured to drive the cooling fan 38. The control portion 100 further controls the conveying speed of the long sheet P based on the fixing portion temperature t detected by the temperature sensor 39.

Figure 7:
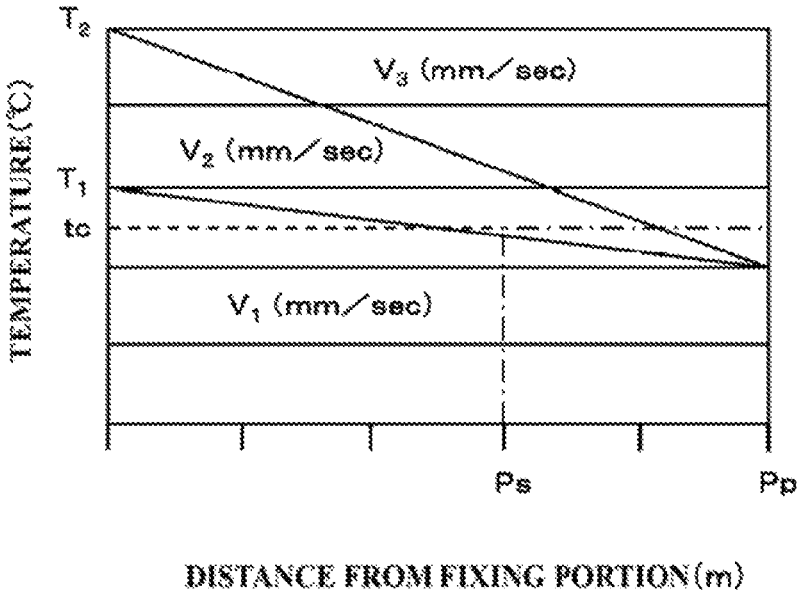
FIG. 7 is a graph showing a relationship between fixing portion temperature and a conveying speed of the long sheet.

FIG. 7 shows a relationship between the fixing portion temperature and the conveying speed of the long sheet. In a graph shown in FIG. 7, a vertical axis represents temperature (degrees C.) and a horizontal axis represents a distance (m) from the fixing portion 3. In this embodiment, until the rear end Pe of the image Pc reaches the image confirmable position Pp, the control portion 100 is configured to finish the cooling operation of the fixing roller 31 and the like.

As described above, the image confirmable position Pp is set to be a predetermined position in which the image(s) expose(s) at an outermost circumference of the rolled paper P12 that is formed by reeling the long sheet P with the reeling apparatus 140. In this embodiment, an introducing port position Ps of the reeling apparatus 140 in which the introducing port 140*a* is provided or the conveying guide rollers 140*b* provided at an uppermost stream side in the reeling apparatus 140 may be set to be a start position of an image confirmable range Pv. The predetermined position in which the image(s) expose(s) at an outermost circumference of the rolled paper P12 may be set to be a finish position of the image confirmable range Pv.

Accordingly, by finishing the cooling operation while the rear end Pe of the image Pc stays in the image confirmable range Pv after a start of the cooling operation of the fixing roller 31 and the like, it is possible to finish the cooling operation of the fixing roller 31 and the like when the rear end Pe of the image Pc reaches the image confirmable position Pp.

In the cooling operation of the fixing roller 31 and the like, when comparing a case where the fixing portion temperature t detected by the temperature sensor 39 is high with a case where the fixing portion temperature t detected by the temperature sensor 39 is low, it takes longer to cool the fixing roller 31 and the like to a predetermined temperature in the case where the fixing portion temperature t is high.

Here, a distance from the fixing portion 3 to the image confirmable range Pv becomes maximum one at the image confirmable position Pp. Thus, since the distance from the fixing portion 3 to the image confirmable position Pp is fixed, it is necessary to reduce the conveying speed of the long sheet P in the case where the fixing portion temperature t is high, as compared with the case where the fixing portion temperature t is low, in order to finish the cooling operation before the rear end Pe of the image Pc reaches the image confirmable position Pp after the start of the cooling operation of the fixing roller 31 and the like.

Accordingly, time when it is required to drop the fixing portion temperature t detected by the temperature sensor 39 to a target cooling temperature tc is previously measured or calculated based on a simulation or the like. The conveying speed V on which the fixing portion temperature t becomes the cooling temperature tc before the rear end Pe of the image Pc reaches the image confirmable position Pp is calculated to produce the control data. The cooling temperature tc may be the waiting temperature Tw.

In an example shown in FIG. 7, as threshold values of the fixing portion temperature t detected by the temperature sensor 39, first threshold temperature $T_1$ and second threshold temperature $T_2$ that is higher than the first threshold temperature $T_1$ are set. When the fixing portion temperature t detected by the temperature sensor 39 is lower than the first threshold temperature $T_1$, the conveying speed V is set to be $V_1$.

In this embodiment, when the fixing portion temperature t detected by the temperature sensor 39 is lower than the first threshold temperature $T_1$, the conveying speed V is set so that the fixing portion temperature t becomes not more than the cooling temperature tc when the rear end Pe of the image Pc reaches the introducing port position Ps. In such a case, when the rear end Pe of the image Pc reaches the introducing port position Ps, it is possible to finish the cooling operation.

When the fixing portion temperature t detected by the temperature sensor 39 is not lower than the first threshold temperature $T_1$ and lower than the second threshold temperature $T_2$, the conveying speed V is set to be $V_2$. The conveying speed $V_2$ is set to be slower than the conveying speed $V_1$. When the fixing portion temperature t detected by the temperature sensor 39 is not lower than the second threshold temperature $T_2$, the conveying speed V is set to be $V_3$. The conveying speed $V_3$ is set to be slower than the conveying speed $V_2$. Accordingly, each conveying speed V is set so that the fixing portion temperature t can drop to the cooling temperature tc before the rear end Pe of the image Pc reaches the image confirmable position Pp.

When the fixing portion temperature t detected by the temperature sensor 39 is lower than the first threshold temperature $T_1$, the control portion 100 controls the sheet-conveying portion 2 to convey the long sheet P at the conveying speed $V_1$. When the fixing portion temperature t detected by the temperature sensor 39 is not lower than the first threshold temperature $T_1$ and lower than the second threshold temperature $T_2$, the control portion 100 controls the sheet-conveying portion 2 to convey the long sheet P at the conveying speed $V_2$. When the fixing portion temperature t detected by the temperature sensor 39 is not lower than the second threshold temperature $T_2$, the control portion 100 controls the sheet-conveying portion 2 to convey the long sheet P at the conveying speed $V_3$.

When the control portion 100 determines that the fixing portion temperature t detected by the temperature sensor 39 drops to temperature that is the cooling temperature tc or less at a step SA11 shown in FIG. 5, the control portion 100 determines whether or not the rear end Pe of the image Pc formed on the long sheet P reaches the image confirmable position Pp, as shown by solid line in FIG. 6, at a step SA12 shown in FIG. 5.

When the control portion 100 determines that the rear end Pe of the image Pc formed on the long sheet P reaches the image confirmable position Pp, the control portion 100 controls the cooling fan 38 to stop the driving thereof and finish the cooling operation of the fixing roller 31 and the like at a step SA13 shown in FIG. 5. The control portion 100 then stops the conveyance of the long sheet P at a step SA14 shown in FIG. 5. The control portion 100 controls the actuator 37*b* to release the pressure roller 32 from the fixing roller 31 and remove the contact of the long sheet P under pressure, at a step SA15 shown in FIG. 5.

<Excellent Effect Example of Image-Forming Apparatus and Image-Forming System according to Embodiment of the Invention>

When the print job on the long sheet P finishes, the control portion 100 controls the sheet-conveying portion 2 to convey the long sheet P until the rear end Pe of the final image Pc fixed by the fixing portion 3 reaches the image confirmable position Pp and finishes the cooling operation of the fixing roller 31 and the like before the rear end Pe of the final image Pc reaches the image confirmable position Pp.

The image confirmable position Pp is set within a range from a position that is away from the fixing portion 3 at a downstream side along the conveying direction of the long sheet P by a predetermined distance, in the paper-conveying route of the long sheet P passing through the fixing portion 3, to a position in which the image(s) expose(s) at an outermost circumference of the rolled paper P12 that is formed by reeling the long sheet P with the reeling apparatus 140. This enables the final image Pc formed on the long sheet P to stay within a visual recognition range when finishing the conveyance of the long sheet P after the print job finishes. Accordingly, it is possible to easily search and find out a desired image-formed part of the long sheet P.

By finishing the cooling operation of the fixing roller 31 and the like when the long sheet P is conveyed to the image confirmable position Pp, it becomes unnecessary to convey the long sheet P until the position in which the rear end Pe of the image Pc passes through the image confirmable position Pp, thereby suppressing any marks from being leaved on the long sheet P by heat or the long sheet P from being deformed by heat even when stopping the conveyance of the long sheet P.

Here, if the image confirmable position Pp is set within the image-forming apparatus 1A, after the print job finishes, the conveyance of the long sheet P stops while the rear end of the image remains in the image-forming apparatus 1A so that workability for bring out an image-formed part of the long sheet P becomes wrong. Since it cannot obtain any sufficient time to cool the fixing roller 31 and the like, it may generate possibility in which any marks are leaved on the long sheet P by heat or the long sheet P is deformed by heat.

If the image confirmable position Pp is set to be inside from the outermost circumference of the rolled paper P12, the workability for searching the image becomes wrong because there is no visual image on the outermost circumference surface of the rolled paper.

On the other hand, by setting the image confirmable position Pp to be within a range from the introducing port 140*a* of the reeling apparatus 140 to the position in which the image(s) expose(s) at an outermost circumference of rolled paper P12 that is formed by reeling the long sheet P with the reeling apparatus 140, the rear end Pe of the final image Pc formed on the long sheet P stays within a visual range outside the image-forming apparatus 1A when the conveyance of the long sheet P stops after the print job finishes. This enables a work for searching and finding out a desired image-formed part of the long sheet P to be easily performed.

By setting the image confirmable position Pp to be within a range from the conveying guide rollers 140*b* provided at uppermost stream side in the reeling apparatus 140 to the position in which the image(s) expose(s) at an outermost circumference of the rolled paper P12, the rear end Pe of the final image Pc formed on the long sheet P stays within a visual range between the portion of the long sheet P supported by the conveying guide rollers 140*b* and the rolled paper P12. This enables a work for searching and finding out a desired image-formed part of the long sheet P to be easily performed.

When estimating that the rolled paper P12 is a circle and the long sheet P to be reeled as the rolled paper P12 is a tangent line, by setting the image confirmable position Pp to be a position corresponding to the point of contact thereof, the rear end Pe of the final image Pc stays on the visual surface of the outermost circumference of the rolled paper P12. This enables a work for searching and finding out an image-formed part of the long sheet P to be easily performed.

Since the rear end Pe of the final image Pc is conveyed to the surface of the outermost circumference of the rolled paper P12, a distance in which the long sheet P is conveyed can extend in the cooling operation of the fixing roller 31 and the like accompanying the conveyance of the long sheet P so that the time required for the cooling of the fixing roller 31 and the like can be ensured.

By changing the conveying speed of the long sheet P to that of the image-forming time when starting the cooling operation of the fixing roller 31 and the like after the print job on the long sheet P finishes, it is possible to ensure optimal time required for the cooling of the fixing roller 31 and the like and prevent the cooling operation time from being extended more than necessary, thereby shortening the user waiting time.

By detecting the temperature of the fixing portion such as the fixing roller 31 and changing the conveying speed of the long sheet P based on the detected fixing portion temperature, it is possible to ensure optimal time required for the cooling of the fixing roller 31 and the like and further shorten the user waiting time.

By detecting the temperature of the fixing portion and changing the conveying speed of the long sheet P based on the detected fixing portion temperature and the distance to the image confirmable position Pp so that the cooling operation finishes when the rear end of the image reaches the image confirmable position Pp, it is possible to cool the fixing roller 31 and the like further surely, ensure optimal time required for the cooling of the fixing roller 31 and the like and further shorten the user waiting time.

Since the cooling operation of the fixing roller 31 and the like is performed with the long sheet P contacting the fixing roller 31 under pressure, it is possible to radiate heat to the long sheet P, thereby facilitating the cooling of the fixing roller 31 and the like accompanying the conveyance of the long sheet P.

By providing with the cooling fan 38 for blowing a wind to the fixing roller 31 and the like, it is further facilitate the cooling of the fixing roller 31 and the like and shorten the time required for the cooling operation.

This invention is preferably applied to an image-forming apparatus that forms an image on a long sheet by transferring toner images and fixing them on the long sheet, and an image-forming system that is provided with a long sheet supplying apparatus to the image-forming apparatus and a long sheet collecting apparatus that collects the long sheet.

The terms and expressions which have been employed in the foregoing description are used therein as terms of description and not of limitation, and these are no intention, in the use of such terms and expressions, of excluding equivalent of the features shown and described or portions thereof, it being recognized that the scope of the invention is defined and limited only by the claims.

It is to be noted that any technical scope of the claims and/or meaning of term(s) claimed in the claims are not limited to the description in the above-mentioned embodiments. It should be understood by those skilled in the art that various modifications, combinations, sub-combinations and alterations may occur depending on design requirements and other factors insofar as they are within the scope of the appended claims or the equivalents thereof.

What is claimed is:

1. An image-forming apparatus that is connected to a supplying apparatus for supplying a long sheet and a reeling apparatus for reeling the long sheet, the image-forming apparatus comprising:

a conveying portion that conveys the long sheet which is supplied from the supplying apparatus and reeled by the reeling apparatus;

an image-forming portion that forms an image on the long sheet conveyed by the conveying portion;

a fixing portion that fixes the image on the long sheet on which the image-forming portion has formed the image; and a control portion that is configured to control a cooling operation of the fixing portion wherein an image confirmable position in which the image formed on the long sheet is confirmable is set to be within a range from a start position in an image confirmable range, the start position being set at a downstream side of the fixing portion along a conveying direction of the long sheet, to a finishing position in the image confirmable range, the finishing position being set at an outermost circumference of rolled paper reeled by the reeling apparatus, and when an image-forming operation on the long sheet finishes, the control portion is configured to start the cooling operation of the fixing portion, to control the conveying portion to convey the long sheet until a rear end of the image fixed by the fixing portion reaches the image confirmable position and to finish the cooling operation of the fixing portion until the rear end of the image fixed by the fixing portion reaches the image confirmable position.

2. The image-forming apparatus according to claim 1 wherein the control portion is configured to set the image confirmable position to be within a range from the start position in the image confirmable range, the start position being set at an introducing port of the reeling apparatus from which the long sheet is introduced to the reeling apparatus, to a finishing position in the image confirmable range, the finishing position being set at the outermost circumference of rolled paper reeled by the reeling apparatus.

3. The image-forming apparatus according to claim 1 wherein the control portion is configured to set the image confirmable position to be at the outermost circumference of the rolled paper reeled by the reeling apparatus.

4. The image-forming apparatus according to claim 1 further comprising a temperature detection portion that detects temperature of the fixing portion wherein the control portion is configured to perform the cooling operation on the fixing portion until the temperature of the fixing portion detected by the temperature detection portion becomes cooling temperature or less.

5. The image-forming apparatus according to claim 4 wherein the control portion is configured to change a conveying speed of the long sheet from the conveying speed thereof at the image-forming time based on the temperature of the fixing portion detected by the temperature detection portion, when the image-forming portion has formed the image on the long sheet.

6. The image-forming apparatus according to claim 4 wherein the control portion is configured to change a conveying speed of the long sheet from the conveying speed thereof at the image-forming time based on the temperature of the fixing portion detected by the temperature detection portion and a distance up to the image confirmable position, when the image-forming portion has formed the image on the long sheet.

7. The image-forming apparatus according to claim 1 wherein the control portion is configured to change a conveying speed of the long sheet from the conveying speed thereof at the image-forming time, when the image-forming portion has formed the image on the long sheet.

8. The image-forming apparatus according to claim 1 further comprising a cooling portion that blows air to the fixing portion wherein the control portion is configured to control the cooling portion to perform a cooling operation on the fixing portion by any of stopping energization to the fixing portion, reducing a value of voltage across the fixing portion or a value of current flowing through the fixing portion, and blowing the air by the cooling portion or a combination thereof.

9. The image-forming apparatus according to claim 1 wherein the fixing portion is provided with a driving mechanism to drive a pair of a fixing roller and a pressure roller so as to contact to each other with the fixing roller and the pressure roller being pressured or to be released from each other; and the control portion is configured to control the driving mechanism to contact the long sheet to the fixing roller by the pressure roller under pressure and to perform the cooling operation on the fixing portion with the long sheet being conveyed, and is configured to control the driving mechanism to release the pressure roller from the fixing roller to release the long sheet from the fixing roller.

10. The image image-forming apparatus of claim 1, wherein the conveying portion conveys the long sheet along a paper-conveying route, and the long sheet remains present on the paper-conveying route after the image has been formed.

11. An image-forming system comprising:

a supplying apparatus that supplies a long sheet;

a reeling apparatus that reels the long sheet; and an image-forming apparatus that is connected to the supplying apparatus and the reeling apparatus, the image-forming apparatus comprising:

a conveying portion that conveys the long sheet which is supplied from the supplying apparatus and reeled by the reeling apparatus;

an image-forming portion that forms an image on the long sheet conveyed by the conveying portion;

a fixing portion that fixes the image on the long sheet on which the image-forming portion has formed the image; and a control portion that is configured to control a cooling operation of the fixing portion wherein an image confirmable position in which the image formed on the long sheet is confirmable is set to be within a range from a start position in an image confirmable range, the start position being set at a downstream side of the fixing portion along a conveying direction of the long sheet, to a finishing position in the image confirmable range, the finishing position being set at an outermost circumference of rolled paper reeled by the reeling apparatus, and when an image-forming operation on the long sheet finishes, the control portion is configured to start the cooling operation of the fixing portion and to control the conveying portion to convey the long sheet until a rear end of the image fixed by the fixing portion reaches the image confirmable position and to finish the cooling operation of the fixing portion until the rear end of the image fixed by the fixing portion reaches the image confirmable position.

12. The image image-forming system of claim 11, wherein the conveying portion conveys the long sheet along a paper-conveying route, and the long sheet remains present on the paper-conveying route after the image has been formed.

* * * * *